US005387387A

United States Patent [19]

James et al.

[11] Patent Number: 5,387,387

[45] Date of Patent: Feb. 7, 1995

[54] METHOD AND APPARATUS FOR DRY SPINNING SPANDEX

[75] Inventors: Alexander James, Greenville; Daniel C. James, Spartanburg, both of S.C.

[73] Assignee: Alex James & Associates, Inc., Greenville, S.C.

[21] Appl. No.: 128,401

[22] Filed: Sep. 30, 1993

[51] Int. Cl.[6] ..... D01D 4/02; D01D 5/04; D01F 6/78

[52] U.S. Cl. ..... 264/205; 264/211.12; 264/211.17; 425/72.2; 425/377; 425/378.2; 425/382.2; 425/464

[58] Field of Search ..... 264/205, 211.12, 211.16, 264/211.17, 555; 425/72.2, 377, 378.2, 382.2, 464

[56] References Cited

U.S. PATENT DOCUMENTS 3,111,368 11/1963 Romano ..... 264/205
5,002,474 3/1991 Hoekstra ..... 425/72.2

*Primary Examiner*—Leo B. Tentoni
*Attorney, Agent, or Firm*—Ralph Bailey

[57] ABSTRACT

A method utilizes a hot inert gas flow in an elongated upright heated tube (A) driving off the solvent carrying polymer forming filaments by arranging spinnerettes (B) each forming a bundle of filaments positioned at an upper end of the elongated upright heated tube and providing a horizontal cross-section in the tube corresponding to the spinneret plate (C) and providing an inlet (D) for distributing the hot inert gas flow about the spinnerettes into the tube and delivering the filaments through a slot (E) at the bottom of the tube (A) for winding as upon a beamer or cop winder (F).

7 Claims, 3 Drawing Sheets

METHOD AND APPARATUS FOR DRY SPINNING SPANDEX

BACKGROUND OF THE INVENTION

This invention relates to a method and apparatus for dry spinning spandex yarns and the like providing an increased capacity with improved quality.

Spandex has been dry spun for many years utilizing an upright, elongated tube and spinneret arrangement both of circular cross-section. Spinnerettes may be arranged in coaxial inner and outer rings of grouped orifices each of which is equally spaced from the next succeeding orifice as illustrated in U.S. Pat. No. 5,002,474. The circular configuration limits the number of spinnerettes which may be used in a given tube or station because the hollow formed centrally of the spinneret arrangement becomes excessively large resulting in too great a spacing between centrally located spinnerettes and wasted capacity.

Another difficulty arises from the fact that all of the fibers must be taken up at the bottom of the tube so that the circular configuration makes it relatively difficult to draw the fibers down to be accommodated in a linear slot at the bottom from which the fibers are taken up.

SUMMARY OF THE INVENTION

Accordingly, it is an important object of the present invention to provide a flow of a hot, inert gas such as nitrogen to the filaments found in the tube and yet provide more uniform spacing of filaments in greater number per tube in order to achieve higher quality and increased production for a given set of controllers.

A further object of the invention is to facilitate the taking up of the strands or filaments at the bottom of the tube by producing them in an arrangement of generally linear configuration to begin with so as to accommodate an increased number of strands at the bottom of the tube to be readily taken up on winders, beamers and the like.

These and other objects of the invention are provided by utilizing a spinneret arrangement in the spinneret plate and in the tube of substantially linear transverse configuration in cross section. More than one row of spinnerettes may be utilized, and each row may be staggered within each linear configuration to get more uniform and increased production while facilitating taking up of the resulting fibers at the bottom of the tube.

Another important object of the invention is to utilize the tendency of a gas to flow along the wall of an upright spin tube to best advantage by positioning an increased number of spindles in the space adjacent the tube wall where the effects of the gas may be utilized to increased advantage.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The method of dry spinning spandex filaments utilizes a flow of hot inert gas such as nitrogen, argon or even super heated steam in an elongated upright heated tube A for receiving polymer and solvent forming filaments by driving off the solvent. The method includes the steps of arranging spinnerettes B each delivering polymer and solvent for forming a bundle of filaments substantially linearly transversely of the upright tube along an elongated spinneret plate C and positioning the elongated spinneret plate at an entrance end of the upright heated tube A. By providing a horizontal cross-section in the tube A corresponding to that of the elongated spinneret plate C for receiving the polymer and solvent, bundles of filaments are formed in the heated tube. By distributing the flow of hot inert gas about the spinnerettes and into the tube through inlet means D, removing the filaments from an elongated slot E at an exit end of the tube, and winding the filaments passing through the elongated slot on a takeup F, a flow of hot inert gas is evenly distributed relative to the filaments in the tube and production is increased due to an increased number of spinnerettes.

Figure 1:
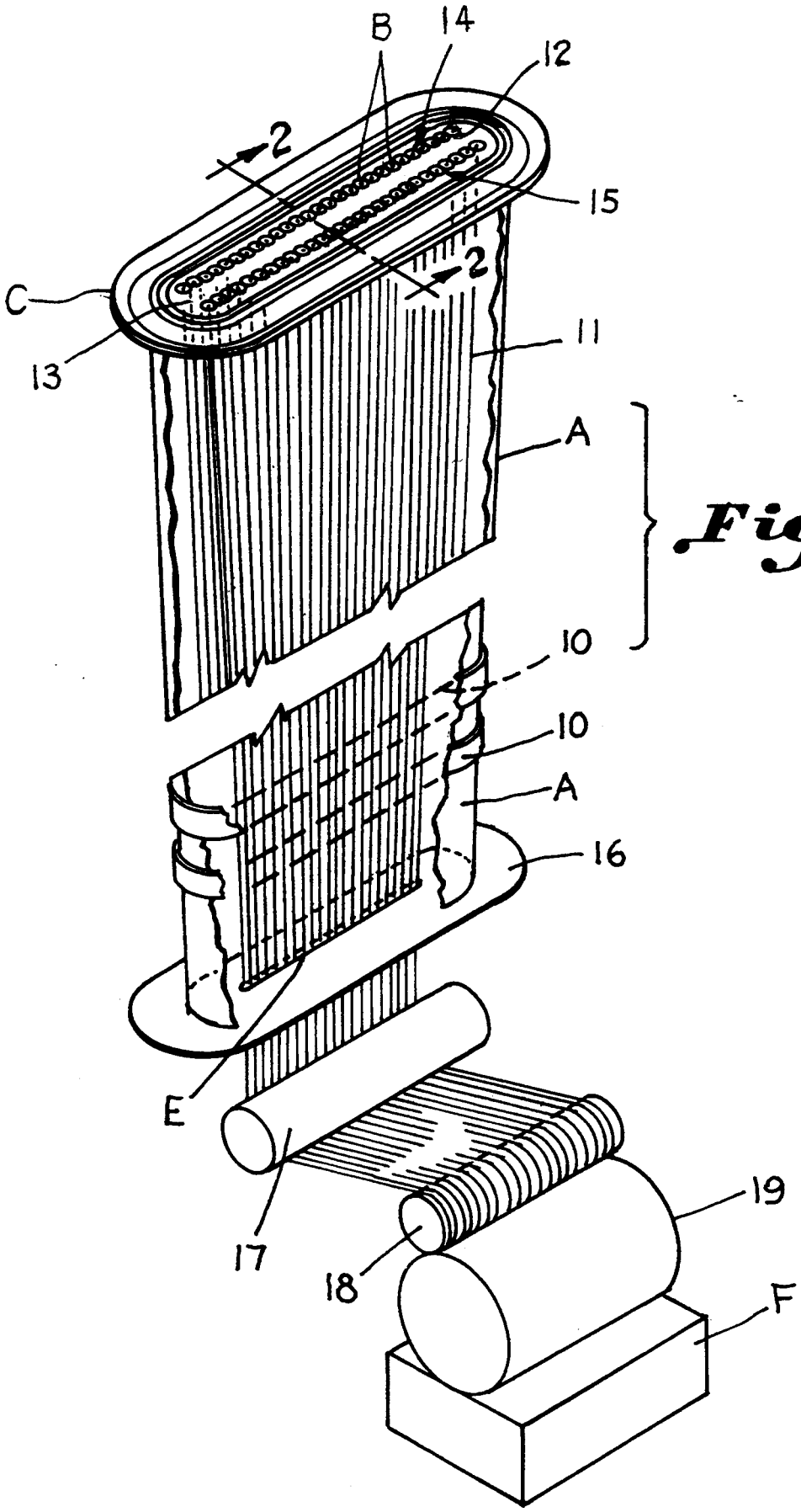
FIG. 1 is a perspective view illustrating a spinneret arrangement in a linear configuration in a generally rectangular spinneret plate with a heated tube of corresponding configuration, constructed in accordance with the invention, for receiving and distributing heated nitrogen about the fibers as they are formed in the tubes.

The upright heated tube A is illustrated as being provided with suitable external heating means such as the electric band heaters schematically illustrated in broken lines as at 10 in FIG. 1 as an aid in heating the tube and the gas. The electric band heaters 10 may be spaced along the length of heated upright tube A for the purpose of driving off the solvent and forming the fibers or strands. Alternatively, the tubes may be jacketed and heated by passing a hot heat transfer media through the jacket. There are several suitable fluids available such as Dow's Dowtherm. Any other suitable heating means may be employed. The heated tube A is illustrated as being generally rectangular in cross section and may be constructed of suitable material for transferring heat and may be provided with insulation (not shown). The heated nitrogen or other inert gas may be introduced into the upright heated tube A by an internal sparge ring (not shown) or by the slot D which surrounds the openings 12 in the horizontal plate 13 for accommodating the spinnerettes B. The plate 13 is suitably supported within the elongated spinneret plate C and the spinnerettes are illustrated as being generally aligned in elongated rows broadly designated at 14 and 15.

The strands 11 exit from a bottom plate 16 in the upright tube A through an elongated slot E. The fibers which have exited pass under a guide roll 17 and over a roll 18 to the beam 19 of a beamer F or any other suitable takeup means.

Figure 2:
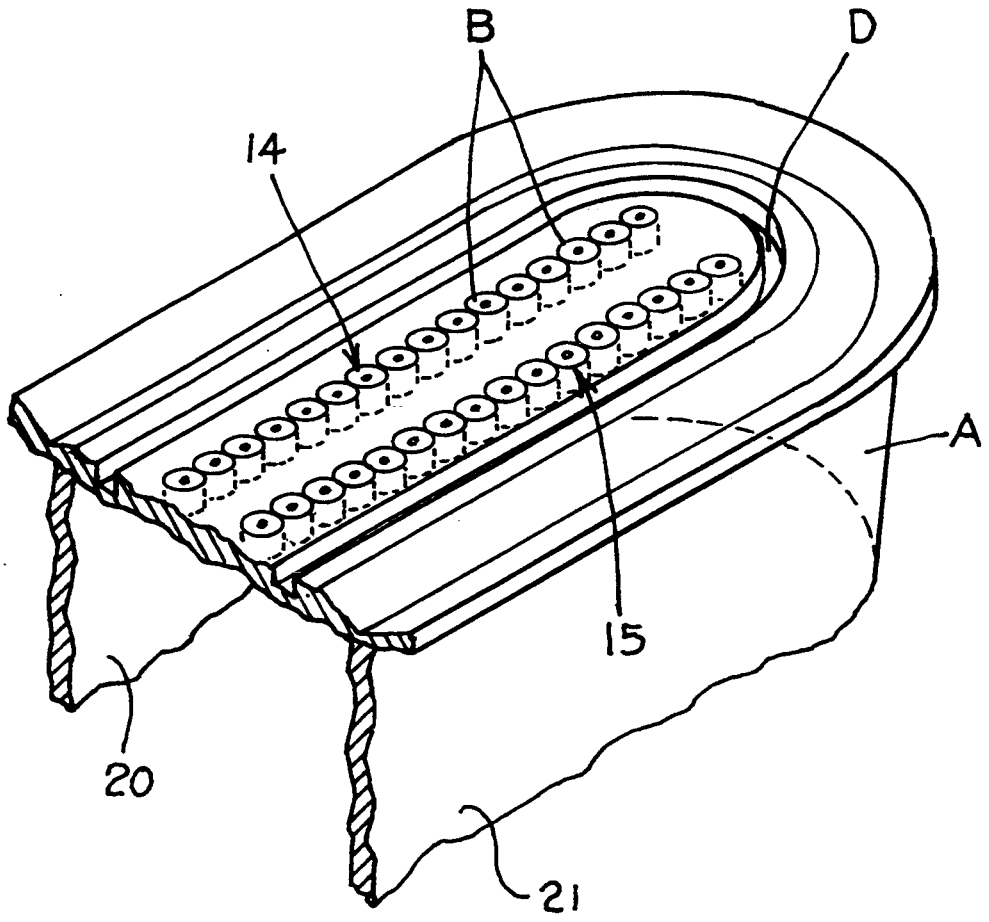
FIG. 2 is a perspective view taken on the line 2—2 in FIG. 1 illustrating the details of the spinnerettes and inert gas inlet for distributing the inert gas within the tube.

FIG. 2 illustrates the front and rear generally flat walls 20 and 21 which are joined by curved end walls 22 which as stated above are preferably constructed of heat conductive material which may be provided with suitable insulation.

Figure 3:
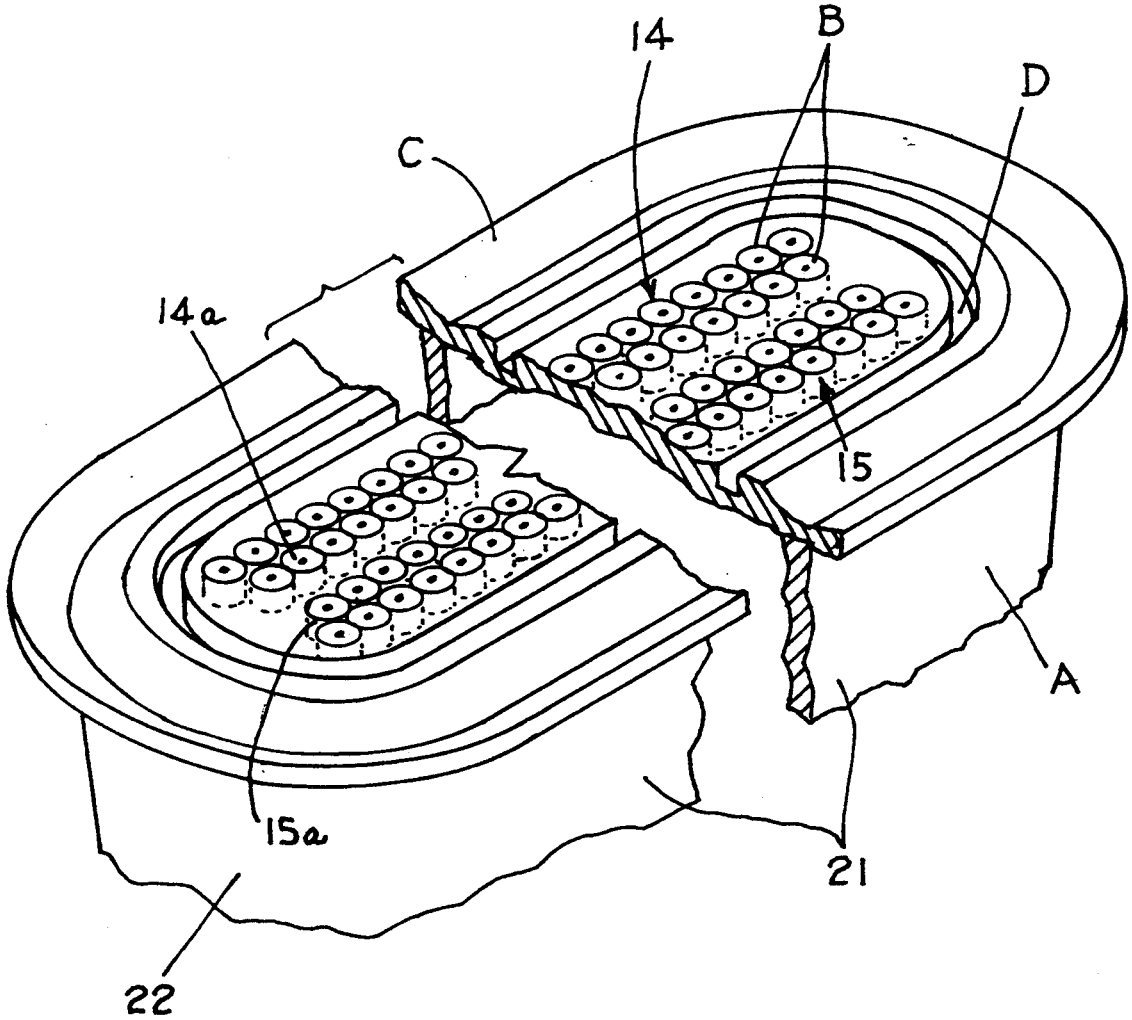
FIG. 3 is an enlarged perspective view of a spinneret plate illustrating a modified form of the invention.

FIG. 3 illustrates a modified form of the invention wherein the rows 14 and 15 utilize spinnerettes B in staggered arrangement wherein inner rows 14*a* and 15*a* have spinnerettes spaced transversely in equal distance between the corresponding outside rows of spinnerettes so that the spinnerettes in each row are equally spaced and in staggered relationship to each other.

A preferred solution for introduction into the tube A is one which has been made by dissolving a multi-component elastomeric polymer with a suitable solvent. This or other suitable liquid medium is introduced through spinnerettes into the tube A wherein the hot gas evaporates the solvent forming solid polymeric filaments.

In spinning spandex fibers and the like, according to the prior art, the filament bundles are formed when the solution passes through spinnerettes in a plate or dye. In spinning filaments in a tube, these spinnerettes must be arranged such that the filament bundles do not tangle while passing through the tube exiting at the bottom of the tube as individual bundles.

By providing for a support structure sufficient to carry these spinnerettes and knowing the width of the spinnerettes, the circumference of the circle required to accommodate the designed number of spinnerettes may be determined. For example, 16 spinnerettes of 1.5 inches diameter plus 0.25 inches on each side for support would require a length of 32 inches or a circle with a diameter of 10.186 inches. To increase the number of spinnerettes, the diameter of the spinneret must be increased or the spinnerettes may be placed in two concentric circles such as illustrated in U.S. Pat. No. 5,002,474. Placing the spinnerettes in two circles requires that the spacing of the spinnerettes in the outer ring be greater than would otherwise be required in order to accommodate the inner ring of spinnerettes with consequent waste of space.

Thus, according to the prior art, hot nitrogen or other inert gas is introduced as by a sparge ring just inside the round tube. The opening or void inside the ring of spinnerettes is large, and if the tube diameter is increased in order to add more spinnerettes, the void would be even greater and more pronounced.

It has been found that by arranging the spinnerettes in a row in accordance with the invention, the number of spinnerettes is not inordinately limited. For example, 64 spinnerettes can be accommodated in a convenient space. By placing two rows of spinnerettes in a generally straight line, each from about 2 inches apart to 16 inches apart, 128 spinnerettes may be placed in a generally rectangular space and allowing a space between these rows of spinnerettes and a smaller space on the outside of each row from about 1 inch to 4 inches, 128 spinnerettes may be accommodated in a space approximately 96 inches long and from 8 inches to 16 inches wide. By arranging two double rows, 128 spinnerettes may be placed in a space 72 approximately inches across the horizontal plate and from 10 inches to 16 inches wide. This last arrangement is believed to be the more practical of the two. A tower of the usual general type with 64 total spinnerettes so disposed in a row and generally 40 inches long is the presently preferred arrangement. By utilizing such spinneret spacing, such may be accommodated in a rectangular configuration better than in a round configuration without additional operating equipment while more efficiently treating the fibers being spun. Since a single winder normally takes up 8 filaments, the number of spinnerettes should be in multiples of 8, or other winding equipment may be used to better advantage.

The flow and distribution of heated gasses required to evaporate the solvent from the formed filaments may be improved by using a generally rectangular tube and generally in line placement of the spinnerettes therein as outlined above. It has been found that when a gas is introduced along a wall of such a tube or vessel at velocities, for example, of from 10 to 150 feet per minute and under low pressure the gas tends to flow along the wall rather than through the center of the vessel, be it round or rectangular. Under pressures above 0.5 PSIG the gas tends to flow more uniformly throughout the entire diameter of the tube. Since heat is applied to the outside of the tube to keep the gas hot enough to evaporate the solvent, this side wall effect allows a better heat transfer from the heated side wall to the gas. This makes the system more efficient because the gas must be constantly heated to offset the evaporative cooling that takes place when the solvent is vaporized.

An additional benefit of having spinnerettes in a straight line or row instead of a round configuration is that the individual filament bundles must converge into a single line or in some cases two single lines to accommodate proper handling or take up of the filaments emerging from the bottom of the spin tube. Since the filaments are already in a straight line, the take up or winding of the filaments is greatly simplified.

Winders for taking up the larger number of filaments must be either capable of taking up all or a portion of these filaments. If the winders can only accommodate taking up a portion of filament bundles then a number of winders must be used. Normally available winders can take up from two to eight filament bundles, therefore six winders taking up eight filament bundles would be required to take up 64 bundles. This makes the takeup operation less costly and more efficient since fewer doffs would be required thereby minimizing the occurrences of missed doffs.

It is thus seen that if a generally rectangular tube is used, a much larger number of spinnerettes can be put in one tube and still have good control of the gas flow. The number of holes would be governed only by one's ability to gather the threads or filaments at the exit slot at the bottom of the tube. A central hollow devoid of filaments is avoided by thus positioning a pair of substantially flat opposed aligned sides forming a generally rectangular tube so that the filaments are arranged in at least one elongated substantially straight row, said filaments being generally equally spaced with respect to next adjacent filaments intermediate and in substantial alignment with the sides.

While a preferred embodiment of the invention has been described using specific terms, such description is for illustrative purposes only, and it is to be understood that changes and variations may be made without departing from the spirit or scope of the following claims.

What is claimed is:

1. The method of dry spinning spandex filaments utilizing a flow of hot inert gas in an elongated upright heated tube for receiving a polymer in a liquid medium for forming filaments in the tube comprising the steps of:

arranging spinnerettes each delivering the liquid medium for forming a bundle of filaments substantially linearly along an elongated spinneret plate;

positioning said elongated spinneret plate across an entrance end of an upright heated tube;

providing a horizontal cross-section in said tube corresponding to said elongated spinneret plate for receiving said liquid medium forming bundles of filaments in said heated tube by positioning a pair of substantially flat opposed aligned sides forming said tube so that said filaments are arranged in at least one elongated substantially straight row, said filaments being generally equally spaced with respect to next adjacent filaments intermediate and in substantial alignment with said sides;

distributing said flow of hot inert gas about said spinnerettes and into said tube;

removing said filaments from an elongated slot at an exit end of said tube; and winding said filaments passing through said elongated slot;

whereby a flow of hot inert gas is evenly distributed relative to said filaments in the tube, avoiding a central hollow devoid of filaments, and increasing production due to an increased number of spinnerettes.

2. The method set forth in claim 1 including arranging said spinnerettes in a plurality of substantially straight rows on said spinneret plate and said bundles in corresponding configuration in said tube.

3. The method set forth in claim 2 including arranging said spinnerettes in said substantially straight rows in staggered relation.

4. Apparatus for dry spinning spandex filaments utilizing a flow of hot inert gas in an elongated upright heated tube for receiving polymer and solvent forming filaments by driving off the solvent comprising:

an elongated spinneret plate having spinnerettes each delivering a liquid medium containing a polymer for forming bundles of filaments arranged substantially linearly in at least one elongated row of substantially equally spaced spinnerettes along the plate;

said elongated spinneret plate being positioned at an entrance end of said upright heated tube;

a pair of opposed flat opposed aligned sides forming a generally elongated rectangular cross-sectional area for said tube, said cross-sectional area corresponding to said elongated spinneret plate for receiving said liquid medium forming bundles of filaments intermediate and in substantial alignment with said sides;

inlet means distributing said flow of hot inert gas about said spinnerettes and in said tube;

an elongated slot for removing said filaments from an exit end of said tube; and means for taking up said filaments passing through said elongated slot;

whereby a flow of hot inert gas is evenly distributed relative to said filaments in the tube, avoiding a central hollow devoid of filaments, and production is increased due to an increased number of spinnerettes.

5. The structure set forth in claim 4 wherein said inlet means is located in said plate about said spinnerettes.

6. The structure set forth in claim 5 wherein said spinnerettes are arranged in a plurality of rows of staggered spinnerettes.

7. The structure set forth in claim 4 including external heating means acting as an aid in heating the tube.

* * * * *